US012215937B2

(12) United States Patent
Gustafsson

(10) Patent No.: US 12,215,937 B2
(45) Date of Patent: Feb. 4, 2025

(54) HEAT EXCHANGER PLATE, AND A PLATE HEAT EXCHANGER

(71) Applicant: ALFA LAVAL CORPORATE AB, Lund (SE)

(72) Inventor: Jörgen Gustafsson, Staffanstorp (SE)

(73) Assignee: ALFA LAVAL CORPORATE AB, Lund (SE)

( * ) Notice: Subject to any disclaimer, the term of this patent is extended or adjusted under 35 U.S.C. 154(b) by 558 days.

(21) Appl. No.: 17/593,978

(22) PCT Filed: Mar. 11, 2020

(86) PCT No.: PCT/EP2020/056479
§ 371 (c)(1),
(2) Date: Sep. 29, 2021

(87) PCT Pub. No.: WO2020/200678
PCT Pub. Date: Oct. 8, 2020

(65) Prior Publication Data

US 2022/0170703 A1 Jun. 2, 2022

(30) Foreign Application Priority Data

Apr. 3, 2019 (SE) ..... 1950410-9

(51) Int. Cl.
*F28F 3/04* (2006.01)
*F28D 9/00* (2006.01)
(Continued)

(52) U.S. Cl.
CPC ..... *F28F 3/046* (2013.01); *F28D 9/005* (2013.01); *F28F 3/08* (2013.01); *F28F 13/08* (2013.01)

(58) Field of Classification Search
CPC ... F28F 3/046; F28F 3/08; F28F 13/08; F28D 9/005
(Continued)

(56) References Cited

U.S. PATENT DOCUMENTS 2,872,165 A * 2/1959 Wennerberg ..... F28F 3/046 165/166
4,307,779 A * 12/1981 Johansson ..... F28F 13/12 165/166
(Continued)

FOREIGN PATENT DOCUMENTS

CN 1174213 C 11/2004
CN 1833153 A 9/2006
(Continued)

OTHER PUBLICATIONS

English Translation of the Office Action (Examination Report) issued Sep. 17, 2021, by the Taiwanese Patent Office in corresponding Taiwanese Patent Application No. 109110796. (11 pages).
(Continued)

*Primary Examiner* — Claire E Rojohn, III
(74) *Attorney, Agent, or Firm* — BUCHANAN INGERSOLL & ROONEY PC

(57) ABSTRACT

A plate heat exchanger comprises a heat exchanger plate having a quadrilateral shape with two opposite primary sides and two opposite secondary sides, and a longitudinal central axis being parallel with the primary sides. The heat exchanger plate comprises a heat exchanger area having a corrugation of ridges and valleys. Four porthole areas are located at a respective corner of the heat exchanger plate and each comprises a respective porthole extending through the heat exchanger plate. An edge area extends around and adjoins the heat exchanger area and the porthole areas. The heat exchanger area comprises a main area and a local part area extending along one of the primary sides and adjoining
(Continued)

the edge area and one of the porthole areas. The valleys of the local part area are tapering towards the longitudinal central axis.

20 Claims, 5 Drawing Sheets

(51) Int. Cl.
*F28F 3/08* (2006.01)
*F28F 13/08* (2006.01)

(58) Field of Classification Search
USPC ..... 165/167
See application file for complete search history.

(56) References Cited

U.S. PATENT DOCUMENTS

| | | | | |
|---|---|---|---|---|
| 4,535,840 | A * | 8/1985 | Rosman | F28D 9/0018 165/DIG. 357 |
| 4,630,674 | A * | 12/1986 | Skoog | F28F 3/046 165/167 |
| 4,781,248 | A * | 11/1988 | Pfeiffer | F28F 3/083 165/166 |
| 5,226,474 | A * | 7/1993 | Hallgren | F28F 3/083 165/110 |
| 6,062,305 | A | 5/2000 | Persson | |
| 6,389,696 | B1 * | 5/2002 | Heil | F28D 9/005 165/146 |
| 6,394,178 | B1 * | 5/2002 | Yoshida | F28F 3/046 165/DIG. 368 |
| 6,702,005 | B1 * | 3/2004 | Blomgren | F28F 3/046 165/906 |
| 7,040,387 | B2 * | 5/2006 | Leuthner | F28D 9/005 165/906 |
| 8,061,416 | B2 * | 11/2011 | Geskes | F28F 3/046 165/DIG. 372 |
| 8,087,455 | B2 * | 1/2012 | Miao | F28F 3/042 165/167 |
| 8,109,326 | B2 * | 2/2012 | Larsson | F28F 3/046 165/166 |
| 8,746,329 | B2 * | 6/2014 | Blomgren | F28F 3/083 165/166 |
| 8,844,610 | B2 * | 9/2014 | Platt | F28D 9/005 165/165 |
| 9,310,136 | B2 * | 4/2016 | Andersson | F28F 3/046 |
| 9,372,018 | B2 * | 6/2016 | Barone | F28F 9/0248 |
| 9,395,125 | B2 * | 7/2016 | Fox | F28F 27/00 |
| 9,448,013 | B2 | 9/2016 | Ito et al. | |
| 9,453,685 | B2 * | 9/2016 | Miao | F28F 3/027 |
| 9,618,280 | B2 * | 4/2017 | Magnier-Cathenod | F28D 9/005 |
| 10,024,604 | B2 * | 7/2018 | Dränkow | F28D 9/0062 |
| 10,145,625 | B2 * | 12/2018 | Persson | F28F 3/083 |
| 11,226,163 | B2 * | 1/2022 | Norén | F28F 3/046 |
| 11,486,657 | B2 * | 11/2022 | Kim | F28D 9/0075 |
| 11,486,658 | B2 * | 11/2022 | Bruckner | F28F 3/06 |
| 2007/0107890 | A1 | 5/2007 | Geskes et al. | |
| 2011/0024097 | A1 * | 2/2011 | Christensen | F28D 9/005 165/166 |
| 2011/0036549 | A1 * | 2/2011 | Christensen | F28F 3/046 165/167 |
| 2014/0182322 | A1 | 7/2014 | Ito | |
| 2016/0282058 | A1 * | 9/2016 | Blomgren | F28F 3/083 |
| 2017/0131041 | A1 * | 5/2017 | Blomgren | F28D 9/005 |
| 2019/0003783 | A1 * | 1/2019 | Hedberg | F28F 3/10 |
| 2021/0310744 | A1 * | 10/2021 | Blomgren | F28F 3/083 |
| 2022/0170703 | A1 * | 6/2022 | Gustafsson | F28F 3/08 |
| 2022/0236016 | A1 * | 7/2022 | Romlund | F28F 3/046 |

FOREIGN PATENT DOCUMENTS

| | | | |
|---|---|---|---|
| CN | 1930437 | A | 3/2007 |
| CN | 101253381 | B | 5/2010 |
| CN | 102770734 | A | 11/2012 |
| CN | 107532858 | A | 1/2018 |
| CN | 109405602 | A | 3/2019 |
| DE | 3301211 | A1 | 7/1984 |
| EP | 1070928 | A1 | 1/2001 |
| EP | 2853333 | A1 | 4/2015 |
| GB | 867869 | A | 5/1961 |
| JP | H06-241672 | A | 9/1994 |
| JP | 2007-500836 | A | 1/2007 |
| JP | 5805189 | B2 | 11/2015 |
| JP | 2019-020057 | A | 2/2019 |
| KR | 20100094236 | A | 8/2010 |
| SU | 937967 | A1 | 6/1982 |
| TW | 201530083 | A | 8/2015 |
| WO | 2005012820 | A1 | 2/2005 |
| WO | 2005/088221 | A1 | 9/2005 |
| WO | 2007/024191 | A1 | 3/2007 |
| WO | 2011073083 | A1 | 6/2011 |
| WO | 2016/180625 | A1 | 11/2016 |
| WO | 2017144230 | A1 | 8/2017 |

OTHER PUBLICATIONS

International Search Report (PCT/ISA/210) and Written Opinion (PCT/ISA/237) mailed on May 15, 2020, by the European Patent Office as the International Searching Authority for International Application No. PCT/EP2020/056479.

Office Action (The First Office Action) issued Mar. 19, 2023, by the National Intellectual Property Administration, P.R. China in corresponding Chinese Patent Application No. 202080026047.9 and an English translation of the Office Action. (14 pages).

English translation of the Office Action (Notice of Reasons for Rejection) issued Jan. 16, 2023, by the Japan Patent Office in corresponding Japanese Patent Application No. 2021-558898. (6 pages).

* cited by examiner

HEAT EXCHANGER PLATE, AND A PLATE HEAT EXCHANGER

TECHNICAL FIELD OF THE INVENTION

The present invention refers to a heat exchanger plate according to the preamble of claim 1. The invention also refers to a plate heat exchanger according to the preamble of claim 11.

BACKGROUND OF THE INVENTION AND PRIOR ART

In plate heat exchangers, for instance for air conditioning applications, it is difficult to obtain enough flow of the heat carrying media, such as water, around the closed porthole area beside the porthole area forming the inlet for heat carrying media. The heat carrying media flowing around the closed porthole area meets a too high flow resistance when to enter the heat exchanger area. This may be due to the relatively high theta pattern of the heat exchanger area, i.e. a pattern of a corrugation that may have a larger so called chevron angle or inclination in relation to the longitudinal central axis of the heat exchanger plate. The relatively high theta pattern creates more turbulence and thus more heat transfer, higher pressure drop and higher flow resistance.

U.S. Pat. No. 9,448,013 discloses a plate heat exchanger includes a plurality of heat exchanger plates each having an inlet and an outlet for a fluid. Each of the heat exchanger plates comprises a heat exchanger area with a corrugation or ridges and valleys.

U.S. Pat. No. 8,109,326 discloses a heat exchanger plate having a heat exchanger area with a corrugation of ridges and valleys. The ridges have a width that varies along the extension of the ridges. The smaller the width of the ridge the smaller the width of the crest portion.

U.S. Pat. No. 4,630,674 discloses a plate heat exchanger includes a plurality of heat exchanger plates. Each of the heat exchanger plates comprises a heat exchanger area with a corrugation or ridges and valleys and four porthole areas. The heat exchanger area is delimited by a gasket. The grooves are tapering from one side of the heat exchanger area whereas the ridges are tapering from the opposite side of the heat exchanger area.

SUMMARY OF THE INVENTION

The purpose of the present invention is to overcome the problems discussed above. More precisely, the purpose of the invention is to provide a heat exchanger plate and a plate heat exchanger that permit an improved flow around a closed porthole.

This purpose is achieved by the heat exchanger plate initially defined, which is characterized in that the valleys of the local part area are tapering towards the longitudinal central axis.

The corrugation of the heat exchanger area, which extends over the heat exchanger area, forms a theta value related to the inclination of the ridges and the values, to the so called chevron angle. The corrugation may thus extend over the main area, or the whole main area or substantially the whole main area. The ridges and valleys of the corrugation of the local part area may continue into the main area, and may thus extend on both the main area and the local part area.

The ridges and valleys of the corrugation of the main area may have a constant, or substantially constant, width along their extension.

The valleys of the corrugation of the local part area thus taper or have a decreasing width in a direction of their extension away from the edge area towards the main area and the longitudinal central axis.

The tapering valleys of the local part area contribute to a reduced flow resistance for a fluid flowing around the porthole inside the edge area and through the local part area towards the main area.

The local part area may comprise at least one valley, at least two valleys or at least three valleys. The local part area may have a triangular like shape. The local part area is smaller, or significantly smaller, than the main area.

According to an embodiment of the invention, said one porthole area comprises a curved outer zone between the edge area and the porthole, wherein the curved outer zone forms a curved valley extending to the local part area. The curved outer zone may thus extend around the porthole of said one porthole area, and may convey the fluid outside and around the porthole that is closed through the local part area and into the main area.

According to an embodiment of the invention, the corrugation of ridges and valleys extends between a top plane and a bottom plane, wherein the ridges extend to the top plane and the valleys extend to the bottom plane. The curved outer zone may be located at the bottom plane.

According to an embodiment of the invention, the corrugation of the valleys of the local part area are tapering to a transition line between the local part area and the main area.

According to an embodiment of the invention, the corrugation of the ridges of the local part area have a constant width along their extension.

According to an embodiment of the invention, the local part area comprises an elongated outer zone extending along and adjoining the edge area, wherein the elongated outer zone is flat, and wherein the ridges and valleys of the local part area extends from the elongated outer zone. The elongated outer zone may form an inlet for the fluid to the local part area. The elongated outer zone may be located at the bottom plane, and thus at the same level as the valleys of the local part area and at the same level as the curved outer zone.

According to an embodiment of the invention, the valleys of the corrugation of the local part area taper from the elongated outer zone. The valleys of the local part area thus may extend from the elongated outer zone to the transition line.

According to an embodiment of the invention, the valleys of the corrugation of the local part area have a respective end portion adjoining the elongated outer zone, wherein the end portions are curved. The curved end portions may permit the fluid to flow more smoothly into the valleys of the local part area.

According to an embodiment of the invention, the inclination of the ridges and valleys of the corrugation is steeper on the local part area than on the main area. The flow resistance may thus be smaller at the local part area than at the main area.

According to an embodiment of the invention, the theta value of the corrugation of the local part area is lower than the theta value of the corrugation of the main area. The local part area may thus present a relatively low pressure drop and a relatively low flow resistance in comparison with the main area.

According to an embodiment of the invention, the ridges and valleys of the corrugation are curved at the transition line. The ridges and valleys may thus permit a smooth transition of the inclination of the ridges and valleys from the local part area to the main area.

According to an embodiment of the invention, the edge area forms a flange, which is inclined in relation to the extension plane p.

The purpose is also achieved by the plate heat exchanger initially defined, which is characterized in that each of the first heat exchanger plates is a heat exchanger plate of the kind defined above.

According to an embodiment of the invention, the first and second heat exchanger plates are permanently joined to each other, preferably brazed.

According to an embodiment of the invention the plate heat exchanger comprises

- a first inlet channel for the first fluid and extending through the porthole of a first one of the porthole areas,
- a first outlet channel for the first fluid and extending through the porthole of a second one of the porthole areas,
- a second inlet channel for the second fluid and extending through the porthole of a third one of the porthole areas, and
- a second outlet channel for the second fluid and extending through the porthole of a fourth one of the porthole areas,
- wherein the local part area of the first heat exchanger plates adjoins the fourth porthole area. The first fluid flowing from the porthole of the first porthole area may flow on the first heat exchanger plate around the fourth porthole area through the local part area and into the main area.

According to an embodiment of the invention, the first inlet channel and the first outlet channel communicate with the first plate interspaces, and the second inlet channel and second outlet channel communicate with the second plate interspaces.

BRIEF DESCRIPTION OF THE DRAWINGS

The present invention is now to be explained more closely through a description of various embodiments and with reference to the drawings attached hereto.

DETAILED DESCRIPTION OF VARIOUS EMBODIMENTS

Figure 1:
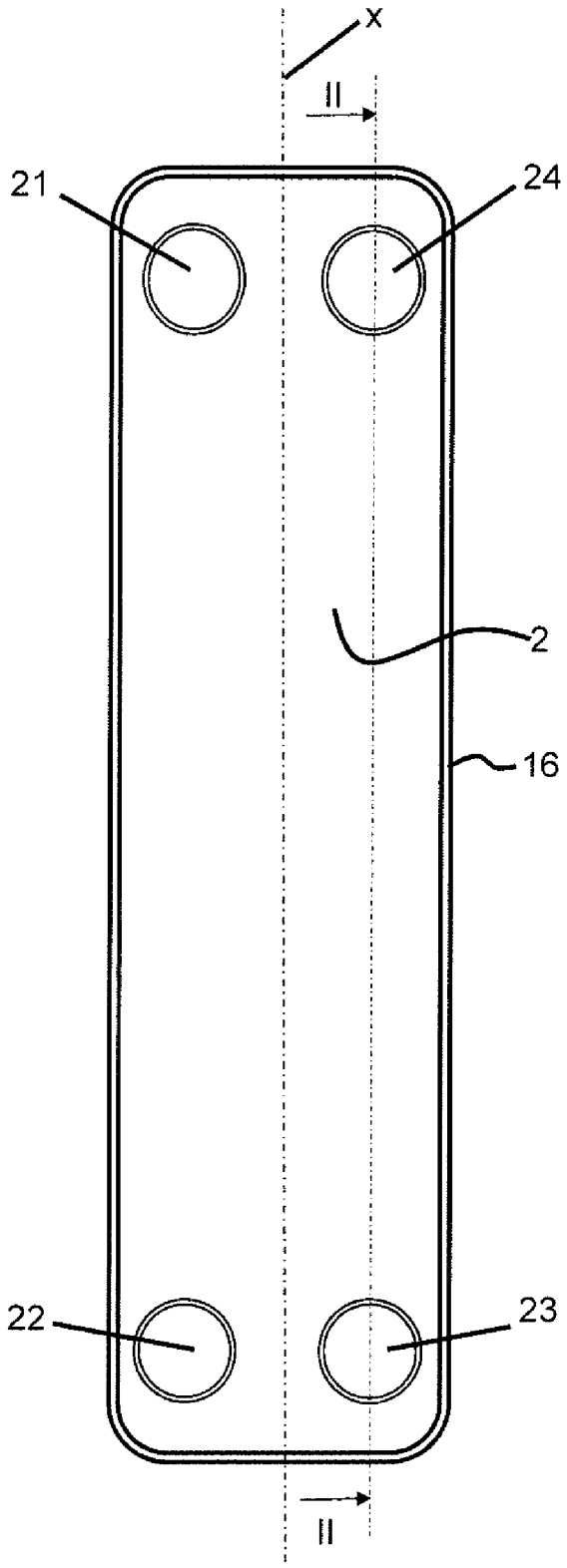
FIG. 1 discloses schematically a plan view of a plate heat exchanger according to an embodiment of the invention.
Figure 2:
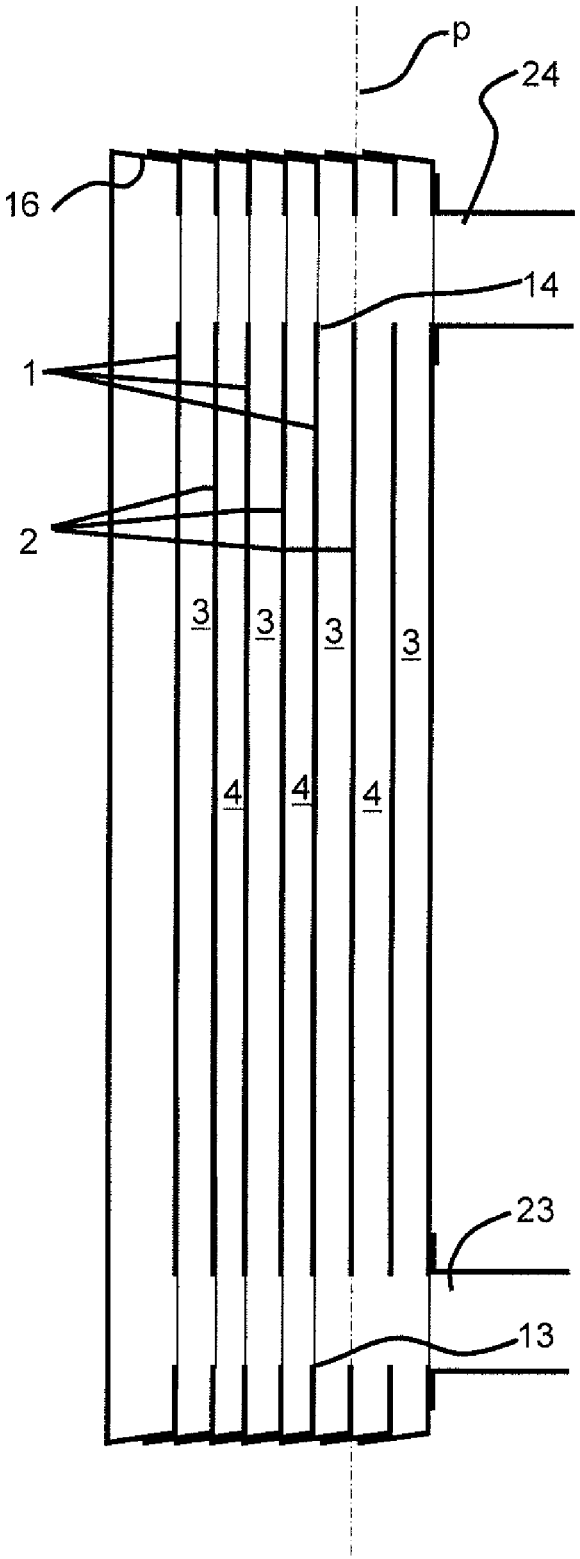
FIG. 2 discloses schematically a longitudinal sectional view along the line II-II in FIG. 1.

FIGS. 1 and 2 disclose a plate heat exchanger comprising a plurality of first heat exchanger plates 1 and a plurality of second heat exchanger plates 2 arranged beside each other in an alternating order in the plate heat exchanger.

The plate heat exchanger may be configured to be operated as an evaporator or a condenser. However, the plate heat exchanger may also be used for other heat exchanging applications. In the embodiments discussed below, the plate heat exchanger is configured to be operated as an evaporator.

Each of the first heat exchanger plates 1 and the second heat exchanger plates 2 extends in parallel with an extension plane p.

The first and second heat exchanger plates 1, 2 are arranged side by side in such in a way that first plate interspaces 3 for a first fluid and second plate interspaces 4 for a second fluid are formed.

In the evaporator application of the embodiment disclosed, the first fluid may be a heat carrying fluid, such as water, and the second fluid any suitable refrigerant.

As can be seen in FIG. 2, each of the first plate interspaces 3 is formed by one of the first heat exchanger plates 1 and an adjacent one of the second heat exchanger plates 2. Each of the second plate interspaces 4 is formed by one of the second heat exchanger plates 2 and an adjacent one of the first heat exchanger plates 1.

The first and second plate interspaces 3, 4 are arranged beside each other in an alternating order as can be seen in FIG. 2.

In the embodiments disclosed, the first and second heat exchanger plates 1, 2 are permanently joined to each other, preferably brazed to each other. The first and second heat exchanger plates 1, 2 may however be mounted together in other ways, for instance be means of tie bolts.

Figure 3:
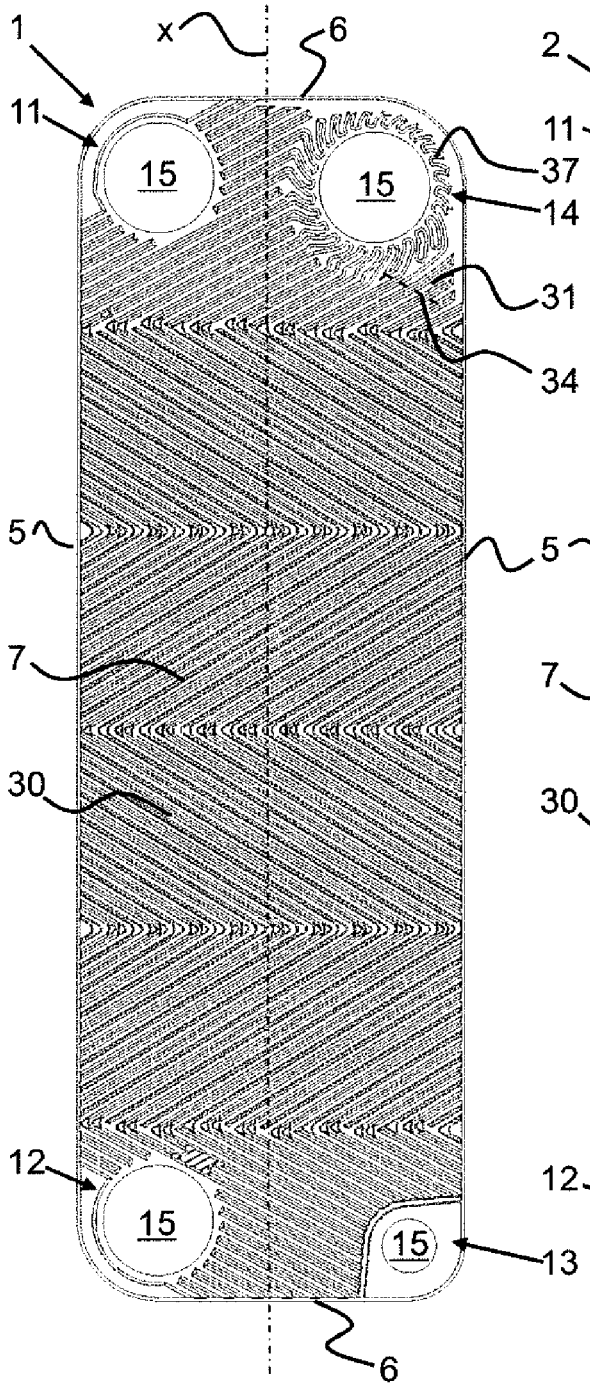
FIG. 3 discloses schematically a plan view of a first heat exchanger plate of the plate heat exchanger in FIG. 1.
Figure 4:
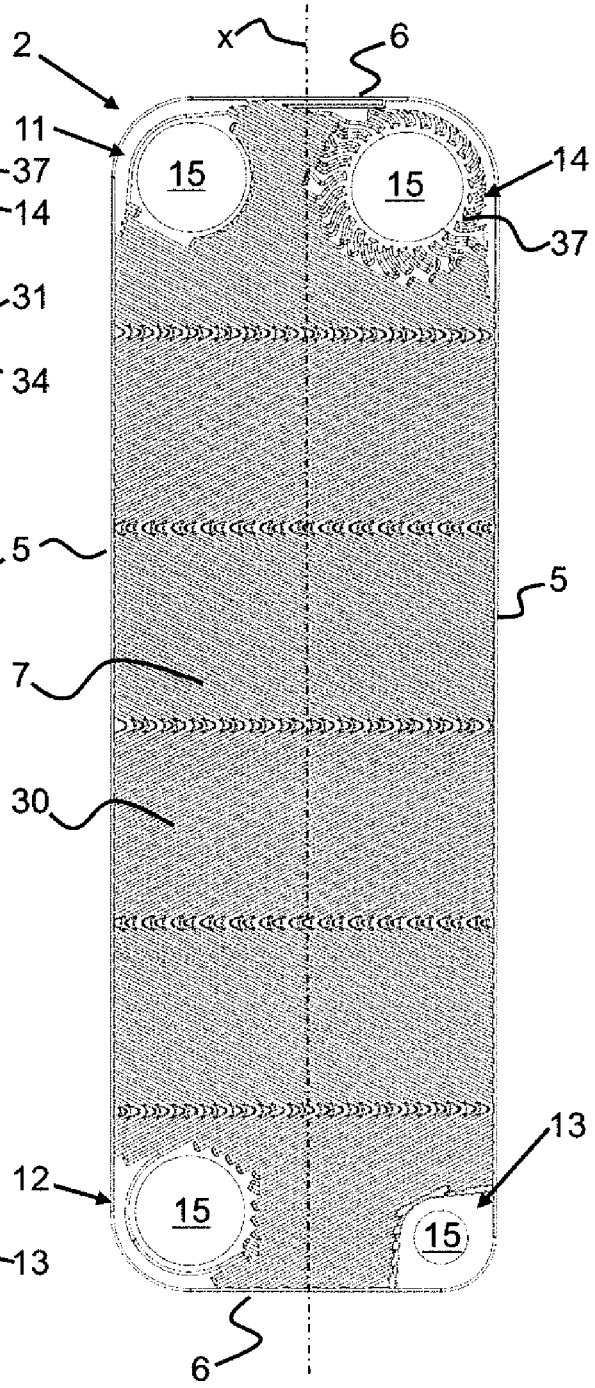
FIG. 4 discloses schematically a plan view of a second heat exchanger plate of the plate heat exchanger in FIG. 1.

As can be seen, especially in FIGS. 3 and 4, each of the first heat exchanger plates 1 and the second heat exchanger plates 2 has a quadrilateral shape with two opposite parallel primary sides 5 and two opposite parallel secondary sides 6. In the embodiments disclosed the quadrilateral shape is rectangular with rounded corners, wherein the primary sides 5 form long sides, and the secondary sides 6 form short sides.

A longitudinal central axis x extends through the secondary sides 6 and is parallel with the primary sides 5. The longitudinal central axis x is parallel with the extension plane p of each of the first and second heat exchanger plates 1, 2.

Figure 5:
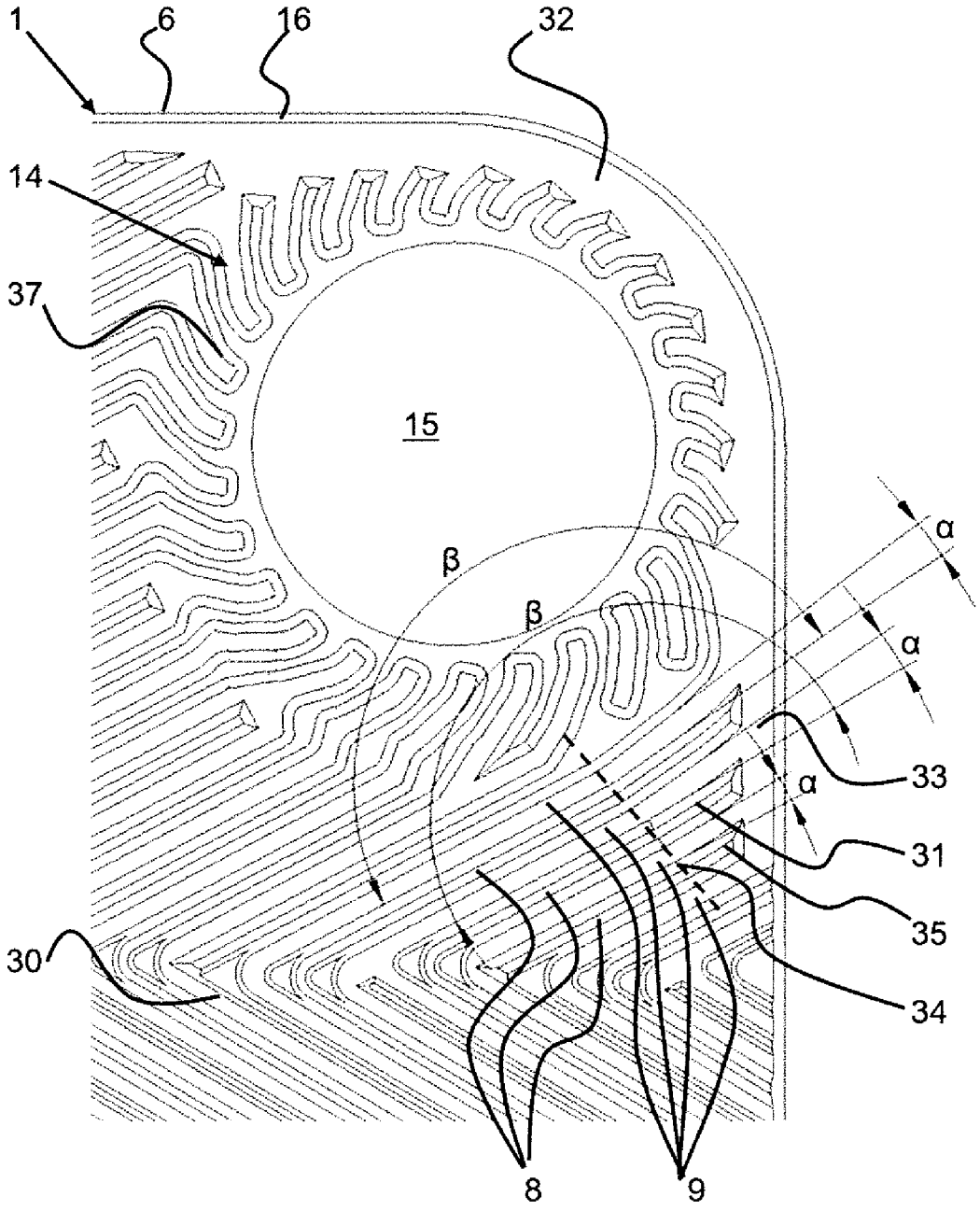
FIG. 5 discloses schematically a plan view of a corner part of the first heat exchanger plate in FIG. 3.

Each of the first and second heat exchanger plates 1, 2 comprises a heat exchanger area 7 having a corrugation of ridges 8 and valleys 9, see also FIG. 5. The heat exchanger area 7 extends in parallel with the extension plane p. The corrugation of ridges 8 and valleys 9 may in a known manner form various patterns, for instance a diagonal pattern, a fishbone pattern, or alternating diagonal patterns as shown in FIGS. 3 and 4.

The corrugation of ridges 8 and valleys 9 extends between a top plane and a bottom plane. The top plane and bottom plane are parallel with each other and with the extension plan p. The ridges 8 extend to the top plane and the valleys 9 extend to the bottom plane.

The ridges 8 and valleys 9 have an inclination in relation to the longitudinal central axis x, also called chevron angle. The corrugation of ridges 8 and valleys 9 forms a theta value related to the inclination. A larger chevron angle, less steep in relation to the longitudinal central axis x, means a higher theta value, and a smaller chevron angle, more steep in relation to the longitudinal central axis x, means a lower theta value.

Each of the first and second heat exchanger plates 1, 2 also comprises four porthole areas 11, 12, 13, 14. Each porthole area 11-14 is located at a respective corner of a respective one of the first and second heat exchanger plates 1, 2, and comprises a respective porthole 15 extending through the first and second, respectively, heat exchanger plate 1, 2.

Furthermore, each one of the first and second heat exchanger plates 1, 2 comprises an edge area 16 extending around and adjoining the heat exchanger area 7 and the porthole areas 11-14. The edge area 16 thus surrounds the heat exchanger area 7 and forms a flange, which is inclined in relation to the extension plane p, see FIG. 2.

The flange of the edge area 16 of one of the first heat exchanger plates 1 may adjoin, and may be joined to the corresponding flange of the edge area 16 of an adjacent one of the second heat exchanger plates 2, in a manner known per se and as can be seen in FIG. 2.

The plate heat exchanger comprises a first inlet channel 21 and a first outlet channel 22 for the first fluid, and a second inlet channel 23 and a second outlet channel 24 for the second fluid, see FIGS. 1 and 2.

The first inlet channel 21 for the first fluid extends through the porthole 15 of the first the porthole area 11. The first outlet channel 22 for the first fluid extends through the porthole 15 of the second porthole area 12. The second inlet channel 23 for the second fluid extends through the porthole 15 of the third porthole area 13. The second outlet channel 24 for the second fluid extends through the porthole 15 of the fourth porthole area 14.

The first inlet channel 21 and first outlet channel 22 communicate with the first plate interspaces 3 in order to supply the first fluid to the first plate interspaces 3 and to discharge the first fluid from the first plate interspaces 3. The second inlet channel 23 and second outlet channel 24 communicate with the second plate interspaces 4 in order to supply the second fluid to the second plate interspaces 4 and to discharge the second fluid from the second plate interspaces 4.

The heat exchanger area 7 of the first heat exchanger plates 1 comprises a main area 30 and a local part area 31. The local part area 31 extends along one of the primary sides 5, and adjoins the edge area 16 and the fourth porthole area 14, as is disclosed more closely in FIGS. 5 and 6.

The ridges 8 and the valleys 9 of the corrugation of the local part area 31 may continue into the main area 30, and may thus extend on both the main area 30 and the local part area 31. The local part area 31 is smaller, or significantly smaller, than the main area 30.

In the embodiments disclosed, the corrugation of the local part area 31 comprises four valleys 9. However, the local part area 31 may comprise less or more than four valleys 9, for instance 1, 2, 3, 5, or even more valleys 9. Each valley 9 is delimited by a ridge 8 of the corrugation.

Figure 6:
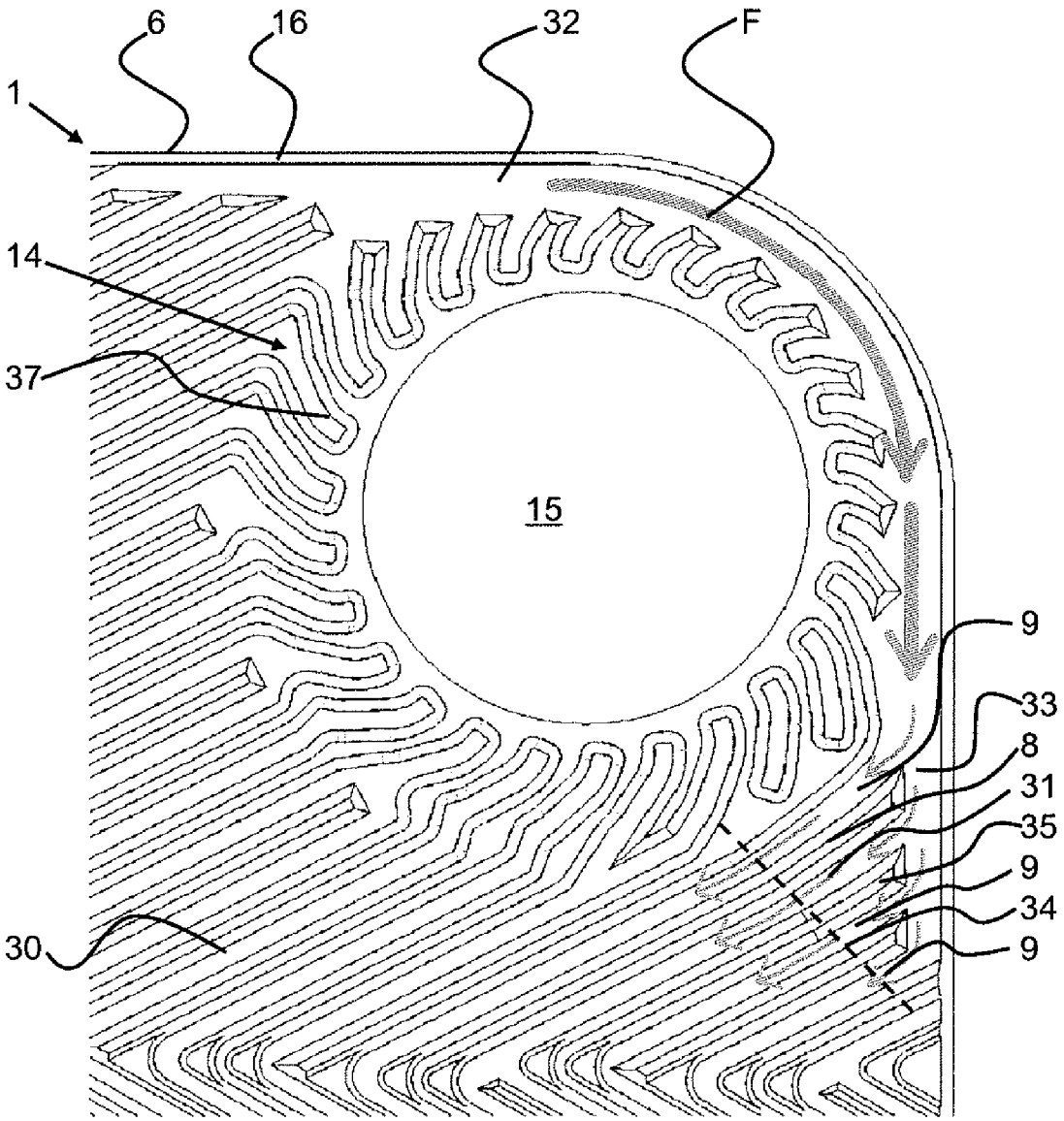
FIG. 6 discloses schematically a plan view of the corner part in FIG. 5 and illustrating the flow of a first fluid.

As can be seen in FIGS. 5 and 6, the local part area 31 may have a triangular like shape.

The valleys 9 of the local part area 31 are tapering towards the longitudinal central axis x and towards the main area 30. The tapering valleys 9 may have a semi-conical, or substantially semi-conical, shape.

The tapering valleys 9 of the local part area 31 contribute to a reduced flow resistance for the first fluid flowing on the first heat exchanger plate 1 around the porthole 15 of the fourth porthole area 14 inside the edge area 16 and through the local part area 31 towards the main area 30.

A taper angle $\alpha$ is indicated for three of the four valleys 9 disclosed in FIG. 5. The taper angle $\alpha$ of the valleys 9 may be 2-6°, especially 3 or 4°. The taper angle $\alpha$ may be different for the different valleys 9.

In the embodiments disclosed, the fourth porthole area 14 comprises a curved outer zone 32 located between the edge area 16 and the porthole 15. The curved outer zone 32 may form a curved valley extending to the local part area 31. The curved outer zone 32 may thus be located at the bottom plane, or at least have a lowermost extension at the bottom plane. The curved outer zone 32 may permit a smooth flow of the first fluid around the porthole 15 of the fourth porthole area 14.

The local part area 31 comprises an elongated outer zone 33 which extends along and adjoins the edge area 16. The elongated outer zone 33 may be flat, or substantially flat. The ridges 8 and valleys 9 of the local part area 31 extend from the elongated outer zone 33 towards the main area 30. The elongated outer zone 33 is located at the bottom plane, and thus at the same level as the curved outer zone 32 and the valleys 9 of the local part area 31. The first fluid in the first plate interspaces 3 may thus flow in the direction of the arrows F in FIG. 6 on the curved outer zone 32 to the elongated outer zone 33 and, from there the first fluid is distributed into the four valleys 9 of the local part area 31, as illustrated by the four thinner arrows.

The valleys 9 of the local part area 31 are tapering to a transition line 34 between the local part area 31 and the main area 30. The valleys 9 may thus taper along their extension from the elongated outer zone 33 to the transition line 34 and the main area 30.

The ridges 8 of the corrugation of the local part area 31 have a constant width along their extension. The ridges 8 may thus have the same width from the elongated outer zone 33 to the transition line 34 and the main area 30. The ridges 8 and valleys 9 of the corrugation of the main area 30 may have a constant, or substantially constant, width along their extension.

The valleys 9 of the local part area 31 have a respective end portion 35 adjoining the elongated outer zone 33. The end portions 35 are curved, or slightly curved, as can be seen in FIGS. 5 and 6. The end portions 35 are curved towards the fourth porthole area 14 in an outward direction towards the edge area 16.

The inclination of the ridges 8 and valleys 9 of the corrugation on the local part area 31 is steeper than on the main area 30. The inclination may also contribute to the theta value of the corrugation of the local part area 31 being lower than the theta value of the corrugation of the main area 30. Each of the ridges 8 and the valleys 9 of the local part area 31 may thus form a respective angle $\beta$ with the corresponding ridge 8 and valley 9 of the main area, as is indicated in FIG. 5. The angle $\beta$ may be 170-179°, especially 173-177°.

As can be seen in FIGS. 5 and 6, the ridges 8 and valleys 9 are curved at the transition line 34.

Figure 7:
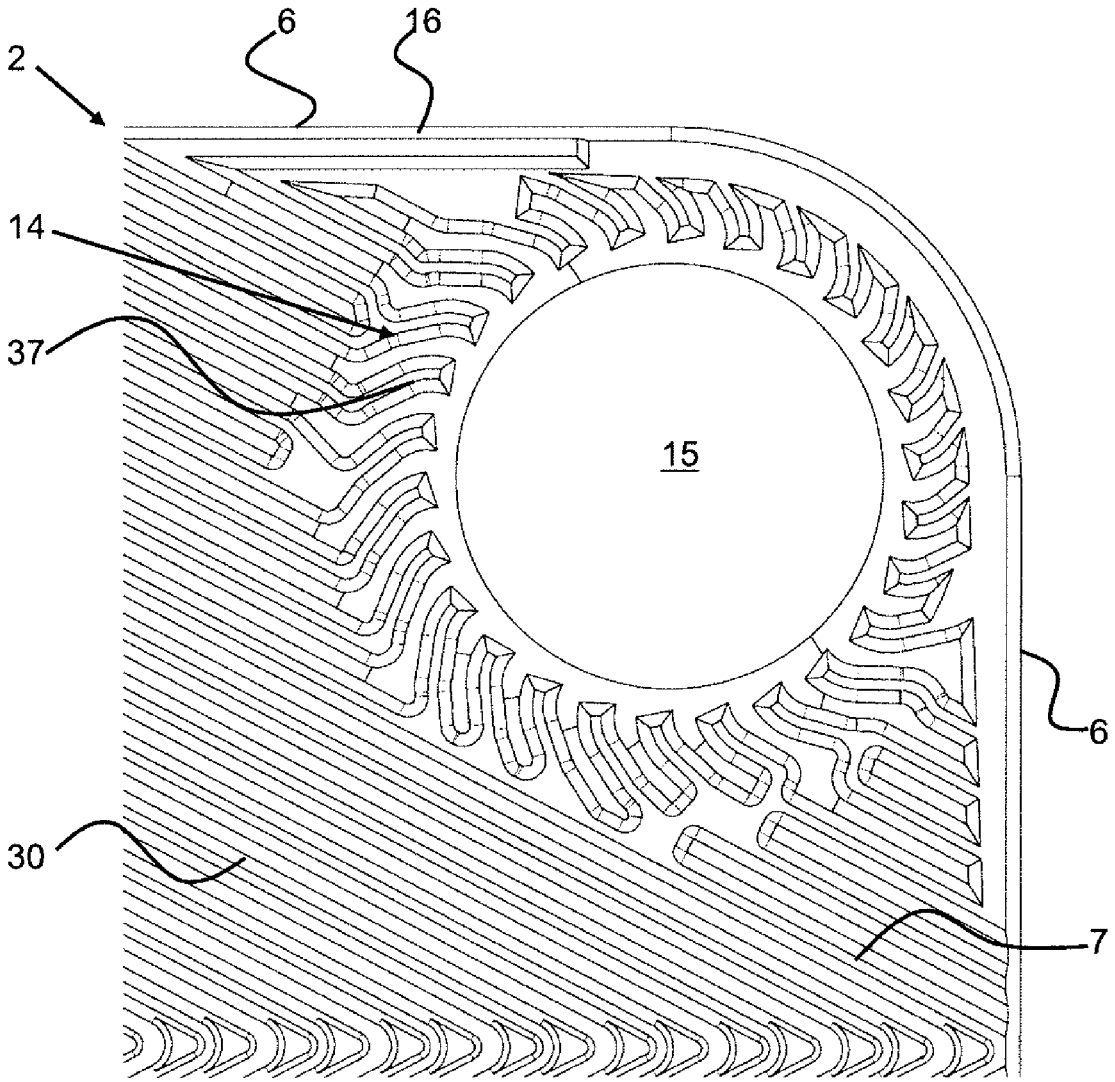
FIG. 7 discloses schematically a plan view of a corner part of the second heat exchanger plate in FIG. 4.

The second heat exchanger plates 2, see FIGS. 4 and 7, have no local part area with tapering valleys 9 or steeper ridges 8 and valleys 9 than the main area 30. Instead, the second heat exchanger plates 2 may have ridges 8 and valleys 9 having a constant width over the whole heat exchanger area 7 and having a constant inclination in relation to the longitudinal central axis x, i.e. chevron angle, over the whole heat exchanger area 7.

The first and second heat exchanger plates 1, 2 may thus be identical except for the local part area 31 and except for the inclination of the ridges and valleys that has the same absolute value but inverted sign. As can be seen in FIGS. 3 and 4, the first and second heat exchanger plates 1, 2 may be configured to be piled onto each other in alternating order.

The fourth porthole area 14 of both the first and second heat exchanger plates 1, 2 comprises an annular corrugation 37. The annular corrugation 37 is provided around the porthole 15 of the fourth porthole area 14. The purpose of the annular corrugation 37 is to improve the strength of the fourth porthole area 14. The annular corrugation 37 comprises ridges and valleys extending along a respective extension direction forming an acute angle to a radial line of the porthole 15, see EP3093602.

As mentioned above, the embodiment disclosed refers to an evaporator. According to another embodiment, the heat exchanger plate and the plate heat exchanger may be used as a condenser, wherein the porthole 15 of the fourth porthole areas 14 form the inlet for the secondary fluid, i.e. the refrigerant, and the porthole 15 of the third porthole areas form the outlet for the secondary fluid.

The embodiments disclosed and discussed above are configured for counter-current flow of the first and second fluids. However, the embodiments may alternatively be configured for co-current flow of the first and second fluids, wherein, for instance, the first outlet channel 22 forms an inlet for the first fluid, and the first inlet channel 21 forms an outlet for the first fluid.

The present invention is not limited to the embodiments disclosed but may be modified and varied within the scope of the following claims.

The invention claimed is:

1. A heat exchanger plate configured to be comprised by a plate heat exchanger, the heat exchanger plate having a quadrilateral shape with two opposite parallel primary sides and two opposite parallel secondary sides, and a longitudinal central axis being parallel with the primary sides and with an extension plane of the heat exchanger plate, the heat exchanger plate comprising:

a heat exchanger area having a corrugation of ridges and valleys, which have an inclination in relation to the longitudinal central axis, wherein the corrugation forms a theta value related to the inclination, four porthole areas each located at a respective corner of the heat exchanger plate and each comprising a respective porthole extending through the heat exchanger plate, and an edge area extending around and adjoining the heat exchanger area and the porthole areas, wherein the heat exchanger area comprises a main area and a local part area extending along one of the primary sides and adjoining the edge area and one of the porthole areas, wherein the valleys of the local part area are tapering in a narrowing manner towards the longitudinal central axis.

2. The heat exchanger plate according to claim 1, wherein said one porthole area comprises a curved outer zone between the edge area and the porthole, and wherein the curved outer zone forms a curved valley extending to the local part area.

3. The heat exchanger plate according to claim 1, wherein the valleys of the corrugation of the local part area are tapering to a transition line between the local part area and the main area.

4. The heat exchanger plate according to claim 1, wherein the ridges of the corrugation of the local part area extend along an extension, the ridges of the corrugation of the local part area having a constant width along their extension.

5. The heat exchanger plate according to claim 1, wherein the local part area comprises an elongated outer zone extending along and adjoining the edge area, wherein the elongated outer zone is flat, and wherein the ridges and valleys of the local part area extend from the elongated outer zone.

6. The heat exchanger plate according to claim 5, wherein the valleys of the corrugation of the local part area taper from the elongated outer zone.

7. The heat exchanger plate according to claim 5, wherein the valleys of the corrugation of the local part area have a respective end portion adjoining the elongated outer zone and wherein the end portions are curved.

8. The heat exchanger plate according to claim 1, wherein the inclination of the ridges and valleys of the corrugation is steeper on the local part area than on the main area.

9. The heat exchanger plate according to claim 8, wherein the theta value of the corrugation of the local part area is lower than the theta value of the corrugation of the main area.

10. The heat exchanger plate according to claim 8, wherein the ridges and valleys of the corrugation are curved at the transition line.

11. A plate heat exchanger comprising:

first heat exchanger plates and second heat exchanger plates arranged beside each other in an alternating order, first plate interspaces for a first fluid, each first plate interspace being formed by one of the first heat exchanger plates and an adjacent one of the second heat exchanger plates, and second plate interspaces for a second fluid, each second plate interspace being formed by one of the second heat exchanger plates and an adjacent one of the first heat exchanger plates, wherein the first and second plate interspaces are arranged beside each other in an alternating order, wherein each of the first heat exchanger plates is a heat exchanger plate according to claim 1.

12. The plate heat exchanger according to claim 11, wherein the first and second heat exchanger plates are permanently joined to each other.

13. The plate heat exchanger according to claim 11, wherein the plate heat exchanger comprises:

a first inlet channel for the first fluid and extending through the porthole of a first porthole area of the porthole areas, a first outlet channel for the first fluid and extending through the porthole of a second porthole area of the porthole areas, a second inlet channel for the second fluid and extending through the porthole of a third porthole area of the porthole areas, and a second outlet channel for the second fluid and extending through the porthole of a fourth porthole area of the porthole areas, wherein the local part area of the first heat exchanger plates adjoins the fourth porthole area.

14. The plate heat exchanger according to claim 12, wherein the first inlet channel and first outlet channel communicate with the first plate interspaces, and wherein the second inlet channel and second outlet channel communicate with the second plate interspaces.

15. A heat exchanger plate configured to be comprised by a plate heat exchanger, the heat exchanger plate having a quadrilateral shape with two opposite parallel primary sides and two opposite parallel secondary sides, and a longitudinal central axis being parallel with the primary sides and with an extension plane of the heat exchanger plate, the heat exchanger plate comprising:

a heat exchanger area having a corrugation of ridges and valleys, which have an inclination in relation to the longitudinal central axis, wherein the corrugation forms a theta value related to the inclination, the ridges and valleys extending along an extension, four porthole areas each located at a respective corner of the heat exchanger plate and each comprising a respective porthole extending through the heat exchanger plate, and an edge area extending around and adjoining the heat exchanger area and the porthole areas, wherein the heat exchanger area comprises a main area and a local part area extending along one of the primary sides and adjoining the edge area and one of the porthole areas, and wherein the valleys of the local part area taper towards the longitudinal central axis so that a width of a first part of the valleys of the local part area is less than a width of a second part of the valleys of the local part area, the first part of the valleys of the local part area being closer to the longitudinal central axis than the second part of the valleys of the local part area.

16. The heat exchanger plate according to claim 15, wherein the one porthole area comprises a curved outer zone between the edge area and the porthole, and wherein the curved outer zone forms a curved valley extending to the local part area.

17. The heat exchanger plate according to claim 15, wherein the valleys of the corrugation of the local part area taper to a transition line between the local part area and the main area.

18. The heat exchanger plate according to claim 15, wherein the ridges of the corrugation of the local part area extend along an extension, the ridges of the corrugation of the local part area having a constant width along their extension.

19. The heat exchanger plate according to claim 15, wherein the local part area comprises an elongated outer zone extending along and adjoining the edge area, the elongated outer zone being flat, and the ridges and valleys of the local part area extending from the flat elongated outer zone.

20. The heat exchanger plate according to claim 15, wherein the inclination of the ridges and valleys of the corrugation is steeper on the local part area than on the main area.

* * * * *